US005670105A

United States Patent [19]

Reinehr et al.

[11] Patent Number: 5,670,105

[45] Date of Patent: Sep. 23, 1997

[54] PROCESS FOR PREPARING MULTIFILAMENT WET-SPUN ELASTANE THREADS

[75] Inventors: Ulrich Reinehr; Günter Türck, both of Dormagen; Tilo Sehm, Düsseldorf; Wolfgang Anderheggen; Toni Herbertz, both of Dormagen, all of Germany; Gino Antolini, Sorisole, Italy

[73] Assignee: Bayer Faser GmbH, Dormagen, Germany

[21] Appl. No.: 597,593

[22] Filed: Feb. 6, 1996

[30] Foreign Application Priority Data

Feb. 10, 1995 [DE] Germany ..... 195 04 316.2

[51] Int. Cl.[6] ..... D01D 5/16; D01F 6/70

[52] U.S. Cl. ..... 264/184; 264/210.5; 264/210.8; 264/211.12; 264/235.6

[58] Field of Search ..... 264/103, 184, 264/210.5, 210.8, 211.12, 235.6, 290.2

[56] References Cited

U.S. PATENT DOCUMENTS 3,526,689 9/1970 Jones et al. ..... 264/103

3,699,205 10/1972 Peters ..... 264/210.4

*Primary Examiner*—Leo B. Tentoni

*Attorney, Agent, or Firm*—Sprung Horn Kramer & Woods

[57] ABSTRACT

The invention relates to a process for preparing multifilament, wet-spun elastane threads with increased spinning output, which is achieved by largely removing entrained water from the filaments after leaving the spinning bath and then fixing the threads on at least two rollers at a temperature of at least 200° C. for at least 3 seconds.

12 Claims, 2 Drawing Sheets

PROCESS FOR PREPARING MULTIFILAMENT WET-SPUN ELASTANE THREADS

BACKGROUND OF THE INVENTION

The invention relates to a process for preparing multifilament, wet-spun elastane threads with a high spinning output. Elastane threads are mainly produced at present by dry and wet spinning processes. Approximately 90% of elastane threads world-wide are prepared by a dry spinning process. One essential reason for this, inter alia, is the much higher spinning output per spinning nozzle. This applies in particular in the field of fine titers, in the range less than 80 dtex. Thus, elastane threads can easily be prepared by means of dry spinning, depending on the titer, at a rate of spinning of about 200 to 600 m/min, whereas a rate of about 3 to 30 m/min is usual during wet spinning (see, Bela von Falkai "Synthesefasern", Verlag Chemie, Weinheim, 1981, Polyurethane-Elastomerfsern, Spinnverfahren, Page 183).

In the case of wet spinning processes, only two methods have gained acceptance on an industrial scale. In the T.V. Peters "Bundle-of-threads process", as it is called, (corresponding to U.S. Pat. No. 3,699,205), several extraction baths are used after the spinning bath to wash out the spinning solvent. Then the threads are fixed in two stages, after gentle roller drying, over a calender in a large drum-dryer, cooled, prepared and wound onto reels. As reported by F. Fourné in Chemiefasern/Textilindustrie, issue 44/96, June 1994, page 394, this process has now, for many reasons, decreased in importance. One reason is, as already mentioned, the low spinning output per nozzle as compared with dry spinning processes. In addition, there is the fact that, due to the long length of thread stretching from the nozzle to the winder, about 90 to 100 m, thread guidance and fixing are very difficult to arrange. There are frequent stoppages of the entire production plant, caused by thread breakage and coil formation, mainly in the region of the fixing procedure.

In another wet spinning process which is more widely known and has been industrially applied (see B. v. Falkai, Synthesefasern 1981, page 184, Table 8), elastane threads are coagulated in an approximately 60 cm long spinning bath, washed with hot water and the threads dried over a roller (see also example 1 in U.S. Pat. No. 3,526,689). The threads are then prepared and wound onto reels. The process was attractive because of its small space requirement as compared with the bundle-of-threads process. Furthermore, as demonstrated in examples 1 to 4 of the Patent specification, a rate of spinning of up to 91.5 m/min is achieved for a titer of 157 or 440 dtex.

The object of the present invention is, starting from the known wet spinning process, to achieve a clear increase in output in a process for preparing elastane threads, both per spinning nozzle and also via the number of spinning locations per spinning bath, and nevertheless thereby to enable a continuous, operationally reliable, mode of working.

SUMMARY OF THE INVENTION

The object is achieved according to the invention by a process for preparing multifilament, wet-spun elastane threads by means of the steps: spinning an up to 35 wt. % strength elastane solution in a spinning bath, washing, optionally stretching, drying, fixing, optionally preparing and winding the threads preferably for the titer range up to 2500 dtex, wherein the process steps stretching, fixing and preparing may be interchanged, at a rate of spinning of up to 200 m/min, and wherein the multifilament threads, on leaving the spinning bath, are taken over a deflection roller which is located directly above the spinning bath liquid, characterised in that a) entrained water is removed from the multifilament threads, before leaving the washing device and travelling towards the drying or fixing procedure, by means of a squeezing roller which fits onto a roller in the washing device, b) the threads are dried or fixed over at least two rollers, wherein c) the temperature of at least one of these rollers is equal to or greater than 200° C. and d) the contact time between threads and heated roller, depending on the titer of the threads and the temperature, is at least 3 seconds.

Elastane threads with a final titer of 22 to 1680 dtex are preferably prepared.

In a preferred variant of the invention, a squeezing roller is used in the washing process made of a material with a Shore hardness of 60 to 80 at an applied pressure of at least 1.5N/cm of roller width.

The preferred spinning solvent is dimethylacetamide (DMAC) and the preferred spinning bath liquid is a mixture of water and DMAC in the ratio by weight of 75 to 95 wt. % of water to 5 to 25 wt. % of DMAC.

DETAILED DESCRIPTION

Using the process according to the invention, it is possible to raise the spinning output per spinning nozzle by more than 50% as compared with the known processes in the prior art (see U.S. Pat. No. 3,526,689), especially if a roller temperature of 220° to 270° C., preferably 240° to 250° C. is used. Furthermore, it has been shown in trials that the fixing time to produce optimum thread characteristics depends on the roller temperature. The higher the roller temperature, the shorter is the contact time required. Whereas, for instance, for a 160 dtex titer about 12 seconds on the two rollers at roller temperatures of 215° and 225° C. respectively is sufficient to achieve a thread strength of 0.95 cN/dtex (cf. Table 2, example 2), the contact time is reduced to about 3 seconds at a roller temperature of 250° C. (cf. Table 2 example 7). Too long a contact time for the elastane threads on the rollers, on the other hand, again leads to a loss of strength. Thus, for example, the strength of elastane threads with a titer of 160 dtex decreases from 0.95 to 0.68 cN/dtex when the residence time on the two rollers at 215° and 225° C. is 33 seconds instead of 12 seconds (cf. Table 2, example 3). Quite generally, it can be said that for fine to moderate titers of up to about 650 dtex, for a roller temperature of 240° C., a contact time of up to about 12 seconds and for coarser titers of up to about 1684 dtex, a contact time of up to about 20 seconds is perfectly adequate to produce good thread characteristics (cf. Table 1).

In a further version of the invention, several possibilities are suggested for drying and fixing elastane threads on at least 2, preferably 4 rollers. A few possibilities are shown in FIGS. 1*a* to 1*d*. Whereas FIG. 1*a* depicts a fixing arrangement from the prior art, FIGS. 1*b* to 1*d* give different arrangements of drying/fixing rollers with and without auxiliary rollers. The embodiments corresponding to FIGS. 1*b* or 1*d*, where all 2 or 4 rollers are heated, are particularly preferably used in the process according to the invention. In general only the drying/fixing rollers are stem-heated or electrically heated, while the auxiliary rollers primarily serve to increase the contact time. All the rollers are arranged so that they are adjustable with respect to both height and lateral position in order to achieve optimum thread throughput. The length and diameter of the rollers are governed by the structure of the wet-spinning device. The dimensions are selected so that it is easy for staff to operate them.

The improvement in spinning output per nozzle of at least 50% as compared with the prior art is produced on the one hand by an increase in rate of spinning and on the other hand an increase in output of at least 100% can also be produced by doubling the number of nozzles per spinning bath. In the processes known from the prior art, this kind of increase in output is not possible because, with the required contact time of at least 3 seconds per thread, the area or length of the rollers cannot be enlarged at all without losing the existing geometry and thus making it difficult to operate the plant. During the course of optimising trials, it was found that preferably up to 4 nozzles can be fitted alongside each other in a 1000 mm long and 400 mm wide spinning bath in order to obtain sufficiently good fixing of the elastane threads at the given high rate of production for the entire range of titers. The high increase in output in the process according to the invention is therefore only possible because the elastane threads are fixed at very high temperatures, preferably at 200° C. or above, and are passed over at least two heated rollers.

In addition to the use of at least two heated rollers, however, other precautions have to be taken so that the hitherto unknown, in a wet-spinning process, high rate of spinning of more than 100 m/min and above can be produced. Thus, for example, the deviation roller at the end of the spinning bath must be located just above the spinning bath liquid, so that a large part of the moisture and solvent entrained by the elastane threads can flow back into the spinning bath. Furthermore, turbulent regions, which can occur due to the high rate of spinning of the elastane threads, can largely be avoided by positioning the roller just above the spinning bath liquid.

A further important prerequisite for the process according to the invention for raising the spinning output per nozzle by at least 50% is the application of a squeezing roller on the roller in the washing device. Due to the high thread speeds, the threads have a moisture and solvent content after leaving the spinning bath which may be up to well above 100 wt. %, with respect to the elastane solids. This type of thread, laden with moisture, can no longer be fixed on the rollers without breaking or forming coils. The threads break apart on the rollers during the evaporation process as a result of the high moisture content. In the process according to the invention, a squeezing roller is inserted, preferably of such a width that it only squeezes the threads which leave the last roller in the washing device, this process is inhibited so that a rate of production of well above 100 m/min can be achieved.

The squeezing roller preferably has a Shore hardness of 60 to 80 and is preferably operated with an applied pressure of at least 1.5N/cm of roller width.

At the high rate of production of elastane threads, especially at a rate of more than 120 m/rain, sprayed-out water increasingly appears around the washing device. The discharge of water to the environs can be avoided, in a preferred process, by using a device in which the entire washing device is completely encapsulated by a dome after starting the plant.

One to several spinning nozzles can generally be fitted in the spinning bath from which the elastane spinning solution is spun. The number of spinning nozzles per spinning bath is governed, inter alia, by the working width of the washing, drying and fixing rollers.

A further possibility for clearly raising the spinning output, in a preferred variant of the process according to the invention, comprises stretching the elastane threads after the washing procedure and at the same time increasing the elastomer solids yield per nozzle in accordance with the stretching ratio.

As shown in FIG. 2, there are several fundamental possibilities for achieving a stretching procedure during the course of the thread production process.

Stretching the elastane threads may be performed, for instance, between the washing device and a first thermal treatment or fixing stages (possibility A: see pairs of rollers 5,6 and 8,9), between the first and a second thermal treatment or fixing stage (possibility B: see pairs of rollers 8,9 and 10,11) or both between the washing device and the first thermal treatment or fixing stage and also between the first and second thermal treatment or fixing stage (possibility C: see pairs of rollers 5,6,8,9 and 10, 11 in FIG. 2). As the test examples show, all 3 possibilities lead to a clear increase in output. Combined with a high rate of spinning, an increase in output of 100% or more may be achieved.

It has been shown, in trials, that the temperature of rollers 8 and 9 (see FIG. 2) should be in particular clearly above 100° C., preferably above 150° C., in order to obtain correspondingly good thread characteristics (see Table 4). This applies to all the stretching possibilities mentioned.

Further preferred embodiments of the invention are given in the sub-claims.

The spinning output per nozzle can be calculated from the overall spinning titer $G_{ST}$(dtex) as follows:

$$L\,(\text{g/h}) = \frac{G_{ST}\,(\text{dtex}) \times \text{spinning pull-off (m/min)} \times 60}{10000}$$

Conversion factors for Table 3 are: 1 den corresponds to 1.11 dtex; 1 yard corresponds to 0.914 m; 1 foot corresponds to 0.304 m and 1 g/den corresponds to 8.82 cN/tex.

The following examples serve to explain the invention in more detail without restricting it. Percentage data refer to weight, provided nothing else is noted.

The thread strength (in dN/dtex) and the maximum tensile force extension (as a %) were determined as described in the standard DIN 53 815.

The rate of spinning in the context of the invention is understood to be the speed at which the thread is withdrawn from the spinning bath.

The invention is explained in more detail by way of example using the figures.

These show:

BRIEF DESCRIPTION OF THE DRAWINGS

FIGS. 1*a* to 1*d* 4 combinations of heated rollers 8, 9, 10 and 11 or unheated auxiliary rollers 14, 15 for drying/fixing the threads.

EXAMPLE 1

Figure 1A:
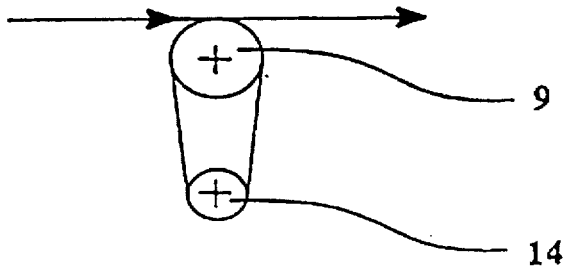
Fig. 1a Prior Art
Figure 1B:
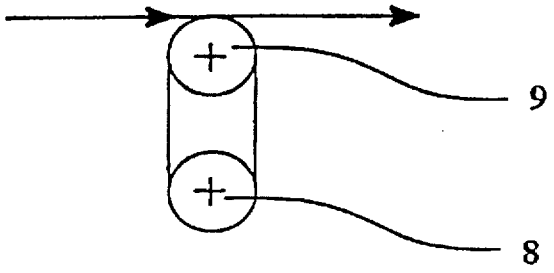

A 30 wt. % elastane spinning solution prepared in accordance with example 7 from DE-OS 4 222 772, which had been pretreated with 0.8% diethylamine for about 10 minutes at 130° C. and had a spinning viscosity of 21 Pa.s measured at 70° C., was spun from 60-hole nozzle 1 with 0.13 mm perforation diameter in spinning bath 3 with 10% strength DMAC solution. The length of the spinning stretch was 460 mm and the spinning bath temperature was 85° C. The threads 2 were withdrawn over deviation roller 4, which was located just above the spinning bath liquid, at 120 m/min, coalesced and then washed in wash bath 16 with two rollers 5,6 by looping 6 times round the two wash rollers 5,6, this corresponding to a residence time of about 3 seconds. After laying out the bundle of threads, a squeezing roller 7, which pressed only onto the elastane threads which were leaving wash roller 6 in the direction of drying/fixing rollers 8,9, was applied to upper wash roller 6. The pressure applied by squeezing roller 7 was 10N. The wash bath temperature was 95° C. The squeezing roller had a Shore hardness of 70 and an application pressure of 2N/cm of roller width. The application pressure could be regulated by applying different counter weights. Finally the entire washing device was encapsulated in a dome which had only one slit for the threads leaving the washing procedure. The twisted threads were then passed over two heated rollers 8,9 by being looped 18 times round the two heated rollers as shown in figure 1*b* and treated at about 240° C., this corresponding to a contact time of about 6 seconds. Then the twisted threads were prepared and wound onto a reel. The threads with a titer of 462 dtex had a thread strength of 0.75 cN/dtex and an extension of 632%. The spinning output per nozzle was 332.6 (g/h). In comparison to example 3 in U.S. Pat. No. 3,526,689 (see also Table 3), where a spinning output per nozzle of only 210.7 g/h was produced, the increase in output was 58%.

Table 1 lists the corresponding spinning and thread characteristics and the spinning output per nozzle (g/h) for further examples in the titer range 22 to 1684 dtex. In all cases, the threads, as described in example 1, were treated on 2 rollers at 240° C. Since, depending on the titer, different amounts of thread passed over the two rollers (22 dtex corresponding to an output per nozzle of 144 g/h and 1684 dtex corresponding to an output per nozzle of 606.2 g/h; see Table 1) the number of loops was varied both as a function of the particular rate of spinning and also of the titer of the elastane threads so that the contact times given in Table 1 were maintained at 3 to 18 seconds.

As a comparison between Table 1 and Table 3 shows, for titers of 160, 435 and 650 dtex (cf. Table 1 examples A2 to A4), in all cases more than a 50% higher spinning output per spinning nozzle was produced as compared with the prior art (cf. Table 3 examples C1, C2 and C4).

EXAMPLE 2

A 30 % strength elastane spinning solution prepared as in example 1 was spun from four 60-hole nozzles with 0.13 mm perforation diameter, which were arranged alongside each other, in a 400 mm wide spinning bath 3. The length of the spinning stretch was 460 mm. The spinning bath concentration was 12% DMAC in water and the spinning bath temperature was 80° C. The threads were, as described in example 1, withdrawn at 120 m/min, washed and then passed over two drying rollers 8,9 as in FIG. 1*b* and fixed at 250° C. by looping 18 times round the two drying rollers 8,9. The residence time for fixing was again about 6 seconds. The four twisted threads were then prepared and wound up individually. The threads with a titer of 468 dtex had a thread strength of 0.70 cN/dtex and an extension of 614%. The spinning output per nozzle was 337 (g/h); the increase in output per spinning nozzle was +60% as compared with example C3 from U.S. Pat. No. 3,526,689 (see Table 3). When using 4 instead of e.g. 2 spinning nozzles in a 400 mm wide spinning bath, the increase in output per spinning bath was 320%.

EXAMPLE 3 a) a 30% strength elastane spinning solution prepared as in example 1 was, as described there, spun from a 60-hole nozzle 1 and washed. The twisted elastane threads were then fixed on 2 drying rollers 8,9 in accordance with example 1. The drying temperature was 185° C. The thread, with a titer of 465 dtex, had a thread strength of only 0.37 cN/dtex at an extension of 574%.

b) The elastane threads in accordance with example 3a were prepared as described there, the fixing time on the two drying rollers 8,9, however, was increased from about 6 seconds to about 14 seconds at a drying temperature of 185° C. by looping 44 times round the two drying rollers 8,9. The threads with a titer of 465 dtex had a strength of only 0.46 cN/dtex and an extension of 584%.

Table 2 lists a variety of fixing possibilities for a titer of 160 dtex. The elastane thread was prepared from a 22-hole nozzle in accordance with the data from example A2, Table 1. The rate of spinning was 81 m/min.

Figure 1C:
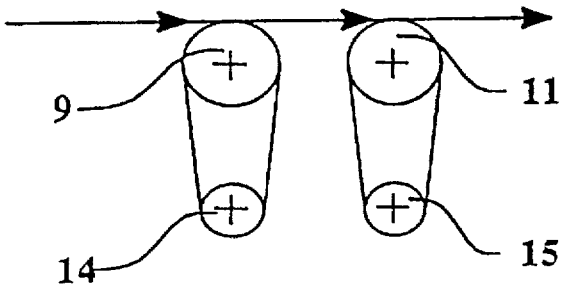
Figure 1D:
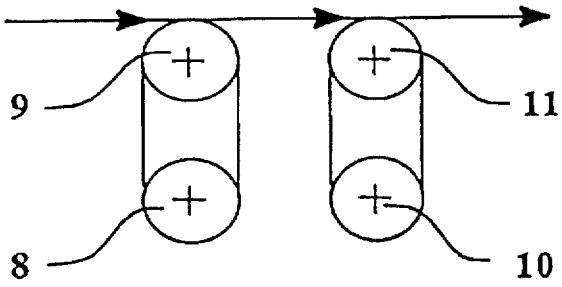

As can be seen from Table 2, example B5, a strength of only 0.67 cN/dtex was achieved for a tiler of 160 dtex at a fixing temperature of 190° C. The strength increased to 0.81 cN/dtex at a fixing temperature of 200° C. (see example no. B6). As shown by example B3 in Table 2, a loss in strength occurred with too long a fixing time. As shown by examples B7 and B8 in Table 2, sufficiently high strength is achieved for the elastane fibres with both an arrangement of drying rollers comparable to FIG. 1*b* and also with one comparable to FIG. 1*c*.

EXAMPLE 4

Figure 2:
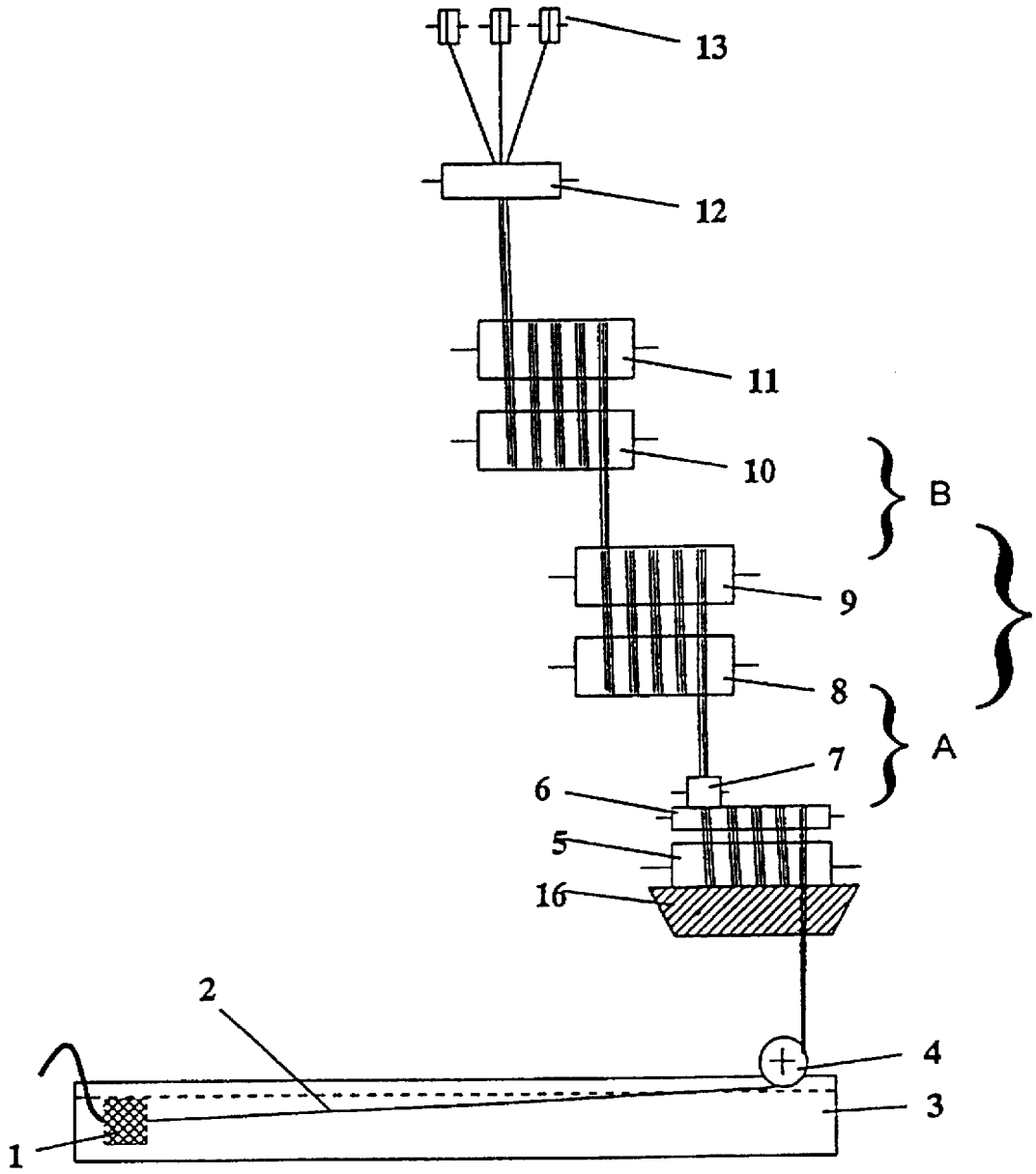
FIG. 2 a diagram of a spinning device used in the preferred process.

(stretching possibility A, see FIG. 2)

A 30% strength elastane spinning solution, prepared as in example 1, was spun in spinning bath 3 from four 60-hole nozzles 1 with 0.13 mm perforation diameter, as described in example 2. The spinning bath concentration was 15% DMAC in water and the spinning bath temperature was 75° C. The threads 2 were withdrawn at 70 m/min over a deviation roller 4 which was located just above the spinning bath liquid, and washed at 95° C. at a rate of 71.5 m/min by looping 6 times round washing rollers 5 and 6.

Then the threads were squeezed by pressure roller 7 after leaving the wash bath and dried at 130° C. with a rate of transport of 143 m/min, by looping several times round heated rollers 8 and 9, and stretched 1:2 fold and then post-fixed under tension at 250° C. on rollers (10 and 11) at a rate of 143 m/min. The contact time on rollers 8 and 9 was 10 seconds and on rollers 10 and 11 was 3 seconds. The threads were then provided with an oil-containing coating in preparation device 12 and wound onto reels on winding device 13.

The threads obtained, with a titer of 166 dtex, had a thread strength of 0.87 cN/dtex and an extension of 577%. The spinning output per nozzle was 142 (g/h). The increase in output per spinning nozzle was +65% in comparison to example C1 from U.S. Pat. No. 3,526,689 (see Table 3).

EXAMPLE 5

(stretching possibility B)

A 30% strength elastane spinning solution, prepared as in example 4 was, as described there, spun into elastane threads and washed. The thread speed in the washing process was again 71.5 m/min.

After the washing process the threads were squeezed with pressure roller 7 and dried at 150° C. at a speed of 73 m/min by looping several times round the two heated rollers 8 and 9. Then the threads were stretched 1:2 fold and fixed at 230° C. by looping several times round heated rollers 10 and 11 at a rate of transport of 146 m/min. The contact time on rollers 8 and 9 was 19 seconds and on rollers 10 and 11 was about 8 seconds. Then the threads, as described in example 4, were prepared and wound up. The threads obtained, with a titer of 170 dtex, had a thread strength of 0.81 cN/dtex and an extension of 521%. The spinning output per nozzle was 149 (g/h). The increase in output per spinning nozzle was +72% when compared to example C1 from U.S. Pat. No. 3,526,689 (see Table 3).

EXAMPLE 6

(stretching possibility C)

A 30% strength elastane spinning solution, prepared as in example 4, was, as described there, spun and washed. The thread speed in the washing process was again 71.5 m/min. After the washing process, the threads were squeezed with pressure roller 7 and dried and 1:2 fold stretched at 200° C. at a speed of 143 m/min by looping several times round heated rollers 8 and 9. Then the threads were post-stretched 1:1.46 fold by looping several times round rollers 10 and 11 at 210 m/min and 250° C. drying temperature. The contact time for the threads on rollers 8 and 9 was 15 seconds and on rollers 10 and 11 was 6 seconds. The entire degree of stretching was 300%. The threads obtained, with a titer of 172 dtex had a thread strength of 1.05 cN/dtex and an extension of 519%. The spinning output per nozzle was 217 (g/h). The increase in output per spinning nozzle was +151% when compared with example C1 in U.S. Pat. No. 3,525,689 (see Table 3).

Table 4 gives further examples of the different stretching possibilities A, B and C (see FIG. 2) for a titer of 160 dtex. The elastane threads were spun in accordance with the data in example 4 from four 60-hole nozzles. The rate of spinning in all cases was 70 m/min and the thread speed in the washing process was 71.5 m/min.

As can be seen from Table 4, increases in output of about at least 60% to 160% and above can be achieved with all 3 stretching variants.

TABLE 1

| Example No. | Titer (dtex) | Nozzle holes No./diam | Speed (m/min) | Contact time with rollers (sec) | Output per nozzle (g/h) | Increase in output (%) as compared with Table 3 | Strength (cN/dtex) | Extension (%) |
|---|---|---|---|---|---|---|---|---|
| A1 | 22 | 6/0.13 | 150 | 3 | 144 | — | 0.93 | 574 |
| A2 | 160 | 22/0.13 | 140 | 3 | 134.4 | 67 | 0.95 | 640 |
| A3 | 435 | 60/0.13 | 140 | 6 | 365.4 | 51 | 0.71 | 587 |
| A4 | 650 | 60/0.13 | 100 | 12 | 390 | 65 | 0.63 | 599 |
| A5 | 864 | 60/0.13 | 100 | 14 | 518.4 | — | 0.53 | 565 |
| A6 | 1684 | 128/0.13 | 60 | 18 | 606.2 | — | 0.5 | 647 |

Spinning output per nozzle (g/h)

TABLE 2

| Example No. | Arranged as in FIG. | Number of drying rollers | Roller temperature Roller nos. 8 + 9 | Roller temperature Roller nos. 10 + 11 | Contact time (sec) Nos. 8 + 9 | Contact time (sec) Nos. 10 + 11 | Titer (dtex) | Strength (cN/dtex) | Extension (%) |
|---|---|---|---|---|---|---|---|---|---|
| B1 | 1d | 4 | 215 | 225 | 3 | 3 | 159 | 0.48 | 537 |
| B2 | " | " | " | " | 6 | 6 | 143 | 0.95 | 640 |
| B3 | " | " | " | " | 33 | 33 | 131 | 0.68 | 752 |
| B4 | " | " | 225 | 240 | 3 | 3 | 157 | 0.91 | 629 |
| B5 | " | " | 190 | 190 | 22 | 22 | 145 | 0.67 | 574 |
| B6 | " | " | 200 | 200 | 22 | 22 | 142 | 0.81 | 596 |
| B7 | 1b | 2 | 250 | " | 3 | — | 151 | 0.93 | 652 |
| | | | Roller nos. 9 + 11 | Roller nos. 14 + 15 | Roller nos. 9 + 11 | Roller nos. 14 + 15 | | | |
| B8 | 1c | 2 | 250 | — | 3 | — | 158 | 0.88 | 657 |

Fixing trials for elastane threads, 160 dtex

TABLE 3

| Example No. | Titer (dtex) | Nozzles (no./diam.) | Speed (m/min) | Output per nozzle (g/h) | Strength (cN/dtex) | Extension (%) |
|---|---|---|---|---|---|---|
| C1 | 157 | 30/0.1 | 91.5 | 86.2 | 0.55 | 550 |
| C2 | 440 | 80/0.1 | 91.5 | 241.6 | 0.61 | 610 |

TABLE 3-continued

| Example No. | Titer (dtex) | Nozzles (no./diam.) | Speed (m/min) | Output per nozzle (g/h) | Strength (cN/dtex) | Extension (%) |
|---|---|---|---|---|---|---|
| C3 | 462 | 80/0.1 | 76 | 210.7 | 0.59 | 690 |
| C4 | 645 | 120/0.16 | 61 | 236.1 | 0.67 | 675 |

Spinning output per nozzle (g/h) according to U.S. Pat. No. 3,526,689.

TABLE 4

| | | Speed (m/min) | | Temperature (°C.) | | Contact time (sec) | | | | | | | |
|---|---|---|---|---|---|---|---|---|---|---|---|---|---|
| Example No. | Stretch variant | Rollers 8/9 | Rollers 10/11 | Rollers 8/9 | Rollers 10/11 | Rollers 8/9 | Rollers 10/11 | Degree of stretch | Output per nozzle (g/h) | Inc. in output % w.r.t Table 3 | Titer (dtex) | Strength (cN/dtex) | Extension (%) |
| D1 | A | 143 | 143 | 95 | 200 | 12 | 14 | 1:2.0 | 143 | 66 | 167 | 0.41 | 220 |
| D2 | A | 143 | 143 | 150 | 250 | 10 | 3 | 1:2.0 | 142 | 65 | 166 | 0.88 | 531 |
| D3 | A | 143 | 143 | 180 | 250 | 12 | 5 | 1:2.0 | 146 | 69 | 170 | 1.05 | 610 |
| D4 | B | 73 | 143 | 170 | 230 | 16 | 8 | 1:2.0 | 147 | 70 | 171 | 0.93 | 543 |
| D5 | B | 73 | 186 | 200 | 250 | 17 | 7 | 1:2.65 | 184 | 113 | 165 | 1.11 | 561 |
| D6 | B | 73 | 224 | 200 | 250 | 17 | 7 | 1:3.2 | 224 | 160 | 167 | 1.14 | 549 |
| D7 | C | 143 | 172 | 180 | 230 | 12 | 6 | 1:2.0 + 1:1.2 | 170 | 97 | 165 | 0.88 | 566 |
| D8 | C | 107 | 160 | 180 | 230 | 14 | 8 | 1:1.5 + 1:1.5 | 166 | 93 | 173 | 0.9 | 557 |

We claim:

1. A process for preparing multifilament, wet-spun elastane threads using the steps: spinning an up to 35 wt. % strength elastane solution in a spinning bath, washing, optionally stretching, drying, fixing, optionally preparing and winding the threads for a titer of up to 2500 dtex, in which process the steps of stretching, fixing and preparing are interchangeable, at a spinning rate of up to 200 m/min and in which the multifilament threads, on leaving the spinning bath, are passed over a deviation roller which is located just above the spinning bath liquid,
wherein a) entrained water is removed from the multifilament threads, before leaving the washing step and travelling towards the drying or fixing procedure, by means of a squeezing roller which fits onto a roller in the washing device, b) then the threads are dried or fixed over at least two rollers, c) the temperature of at least one of said at least two rollers being equal to or greater than 200° C. and d) the contact time between the threads and said roller having a temperature of equal to or greater than 200° C. is at least 3 seconds.

2. A process for preparing elastane threads according to claim 1, wherein the elastane threads have a final titer of 22 to 1680 dtex.

3. A process for preparing elastane threads according to claim 1, wherein the threads are fixed on 2 to 4 rollers.

4. A process for preparing elastane threads according to claim 1, wherein a fixing temperature of 220° to 270° C. is used.

5. A process for preparing elastane threads according to claim 1, wherein the squeezing roller in the wash step has a Shore hardness of 60 to 80 and the application pressure of the roller is at least 1.5 N/(cm of roller width).

6. A process for preparing elastane threads according to claim 1, wherein dimethylacetamide is used as spinning solvent and a mixture of water and dimethylacetamide in the ratio by weight of 75 to 95 wt. % of water to 5 to 25 wt. % of DMAC is used as spinning bath liquid.

7. A process for preparing elastane threads according to claim 1, wherein the elastane threads are fixed on a pair or quartet of rollers, of which at least two rollers are heated.

8. A process for preparing elastane threads according to claim 1, wherein a pair or quartet of rollers are used to fix the elastane threads, with all the rollers being heated.

9. A process for preparing elastane threads according to claim 1, wherein the thread strength for a titer of up to 480 dtex is at least 0.7 cN/dtex and for a titer of equal to or greater than 480 dtex is at least 0.5 cN/dtex.

10. A process for preparing elastane threads according to claim 1, wherein stretching takes place between the rollers in the washing step and the rollers in the fixing and drying steps, wherein the degree of stretch is up to 200%.

11. A process for preparing elastane threads according to claim 1, wherein the drying or fixing process b) is performed over at least four rollers and the threads are stretched between each pair of rollers, wherein the degree of stretch is up to 300%.

12. A process for preparing elastane threads according to claim 11, wherein the threads are also stretched between the rollers in the washing step and the rollers in fixing or drying process b), wherein the degree of stretch each time is up to 300%.

* * * * *